US007225484B1

(12) United States Patent
Ortiz

(10) Patent No.: US 7,225,484 B1
(45) Date of Patent: Jun. 5, 2007

(54) BABY PROTECTOR

(76) Inventor: Hector F. Ortiz, 5019 NW. 113th Ave., Coral Springs, FL (US) 33076

( * ) Notice: Subject to any disclaimer, the term of this patent is extended or adjusted under 35 U.S.C. 154(b) by 644 days.

(21) Appl. No.: 10/741,344

(22) Filed: Dec. 22, 2003

(51) Int. Cl.
*A47D 15/00* (2006.01)

(52) U.S. Cl. ..... 5/424; 5/655; 5/494; 128/872; 128/876

(58) Field of Classification Search ..... 5/424, 5/494, 498, 655, 947; 128/869, 875
See application file for complete search history.

(56) References Cited

U.S. PATENT DOCUMENTS

| | | | | | |
|---|---|---|---|---|---|
| 837,373 | A | * | 12/1906 | Akers | 128/876 |
| 1,502,276 | A | * | 7/1924 | Siebert | 128/875 |
| 3,035,278 | A | * | 5/1962 | Golding | 5/424 |
| 3,570,026 | A | | 3/1971 | Allison | |
| 3,849,813 | A | | 11/1974 | Neilson | |
| 3,965,503 | A | | 6/1976 | Gridel | |
| 4,132,229 | A | * | 1/1979 | Morrison | 128/876 |
| 4,572,174 | A | | 2/1986 | Eilender et al. | |
| 4,657,005 | A | | 4/1987 | Williamson | |
| 4,675,925 | A | | 6/1987 | Littleton | |
| 4,858,625 | A | * | 8/1989 | Cramer | 128/872 |
| 4,911,105 | A | * | 3/1990 | Hocum | 128/875 |
| 5,208,925 | A | * | 5/1993 | Edlund | 5/424 |
| 5,400,803 | A | * | 3/1995 | Vines | 128/872 |
| 6,233,762 | B1 | | 5/2001 | Bradley | |
| 6,381,785 | B1 | | 5/2002 | Mancera Browne | |

* cited by examiner

*Primary Examiner*—Michael Trettel
(74) *Attorney, Agent, or Firm*—Oltman, Flynn & Kubler

(57) ABSTRACT

For use on a bed mattress, a baby protector having a mounting sub-assembly and a baby holding sub-assembly. The mounting sub-assembly has a central portion adapted to overlie the mattress, and adjustable length straps extending from the central portion on opposite sides down to fasteners (preferably snap hooks) for attachment to the bed rail. The baby holding sub-assembly has a short fabric strap affixed at one end to the central portion of the mounting sub-assembly, a snap hook on the free end of this strap, and a self-contained fastener (preferably a safety pin) on this snap hook for attachment to the baby's diaper.

19 Claims, 5 Drawing Sheets

BABY PROTECTOR

BACKGROUND OF THE INVENTION

1. Field of the Invention

This invention relates to a baby protector for holding an infant on an adult size mattress.

2. Prior Art

Various harness or sling devices have been proposed heretofore for holding an infant on an inclined mattress, usually in the crib where the baby usually sleeps. Examples of such proposals are disclosed in the following U.S. patents: Williamson U.S. Pat. No. 4,657,005, Edlund U.S. Pat. No. 5,208,925, and Mancera Browne et al U.S. Pat. No. 6,381,785 B1. The Williamson and Mancera Browne devices are particularly intended for an infant with gastroesophagic reflux ("GER"). Edlund cites the use of his device for an ailing infant, such as one with a head cold or draining sinuses.

SUMMARY OF THE INVENTION

The present invention is directed to a baby protector for holding a baby on a mattress of any size in a manner permitting the baby a limited range of movement, preferably while lying on his or her back, but not enough to slide off the mattress or turn over completely or endanger himself or herself in any way. The present invention is especially useful for holding an infant on an adult mattress, whether single, twin, queen or king size, which is a great convenience for parents taking the child on a visit to grandparents or other relatives or friends or to a hotel or motel where a crib for the baby's use may not be conveniently available. The present baby protector is constructed and arranged for manually releasable attachment to the baby's diaper or other article of clothing without requiring any modification of the diaper or other clothing by the addition to it of one or more fastener elements, such as VELCRO® or snap fasteners. Instead, the attachment is made by a safety pins of known design and proven reliability. This baby protector also preferably has adjustable-length straps and snap hooks of known design and proven reliability for releasably attaching it readily and easily to a bed, crib or other support for the mattress.

A principal object of this invention is to provide a novel and advantageous baby protector for holding a baby in his or her usual sleeping or rest position on a mattress in a manner which permits the baby a limited range of movement.

Another object of the invention is to provide such a baby protector which has self-contained, complete, manually operable fasteners, preferably safety pins, for releasably attaching it to the baby's diaper or other article of clothing without requiring the provision of any fastener elements on the diaper or other clothing itself, so that special diapers or other clothing are not needed to make the present baby protector operable and effective.

Another object of this invention is to provide such a baby protector which is readily adjustable for use on any size mattress and is readily attachable to and detachable from the bed or other support for the mattress on which the baby will lie.

Further objects and advantages of this invention will be apparent from the following detailed description of four presently preferred embodiment thereof, with reference to the accompanying drawings.

DETAILED DESCRIPTION OF THE INVENTION

Before explaining the present invention in detail it is to be understood that the invention is not limited in its application to the particular arrangement shown and described since the invention is capable of other embodiments. Also, the terminology used herein is for the purpose of description and not of limitation.

Figure 1:
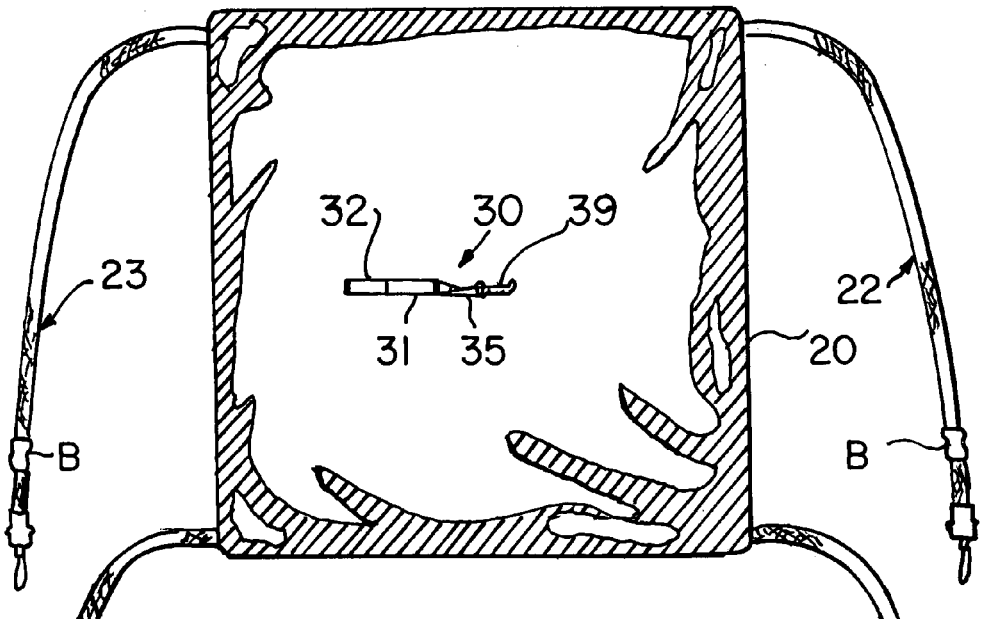
FIG. 1 is a top plan view of a first embodiment of the present baby protector.
Figure 2:
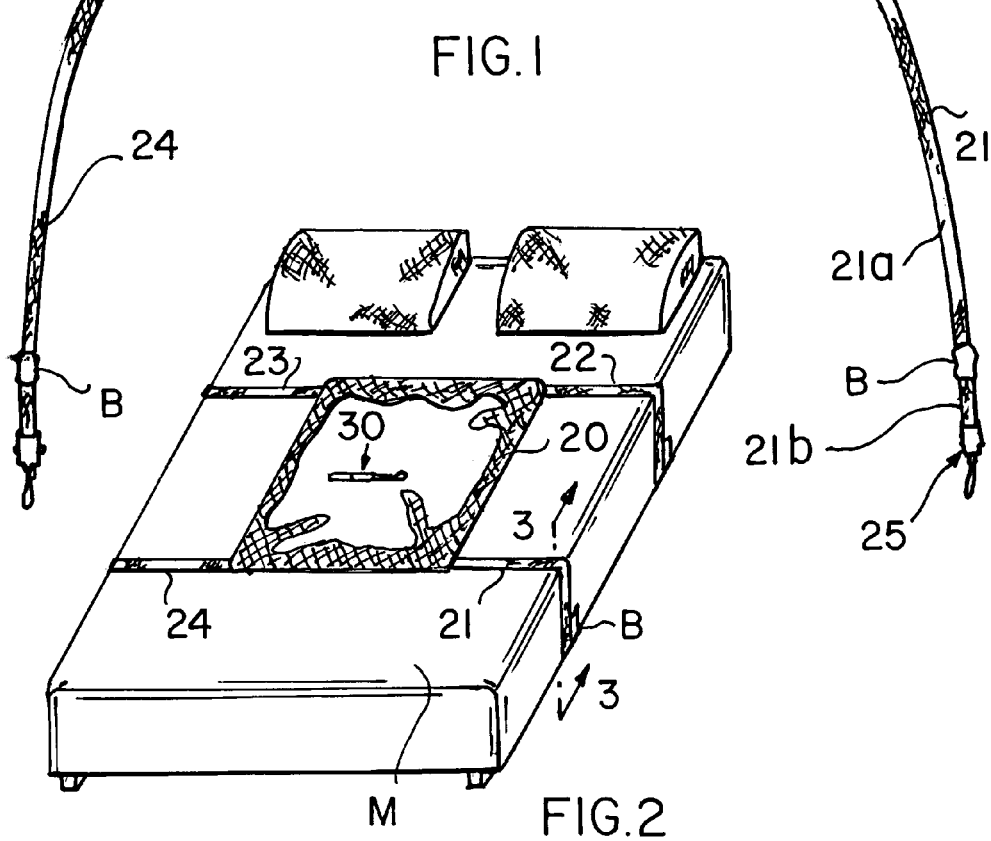
FIG. 2 is a perspective view of the FIG. 1 baby protector in place on an adult size mattress.
Figure 3:
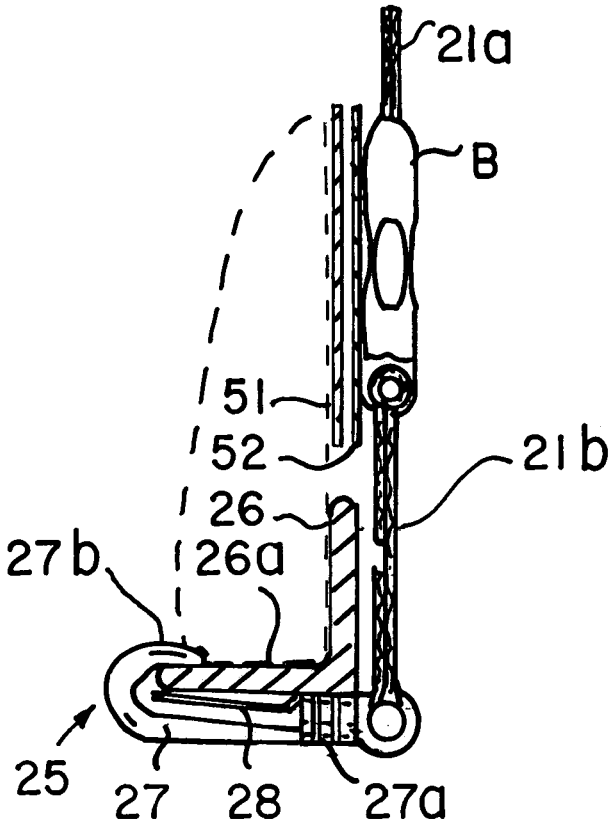
FIG. 3 is a cross-section taken along the line 3—3 in FIG. 2 and showing one of the baby protector's snap hook attachments to a bed frame.
Figure 4:
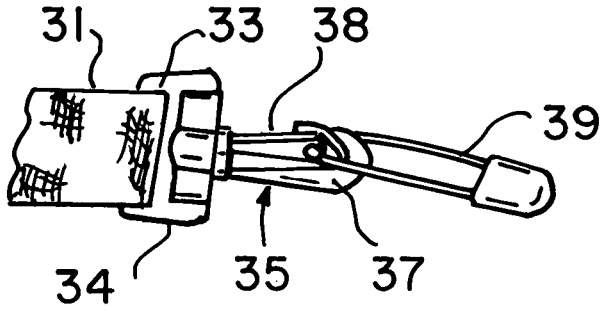
FIG. 4 is a side elevation of the snap hook and safety pin sub-assembly in the baby protector for all of the illustrated embodiments of the invention.

Referring to FIGS. 1–4, the baby protector shown there is to be positioned on the mattress M of an adult-sized bed which has sheets, S1 and S2 (FIG. 3). In this embodiment the baby protector has a flat, rectangular, fabric, central, top panel 20 designed to lie on top of the mattress, with the baby lying on top of panel 20. Panel 20 is the central portion of a mounting sub-assembly in this embodiment of the present baby protector.

The mounting sub-assembly also includes four elongated, flexible, adjustable-length, two-piece mounting straps 21, 22, 23 and 24 which are joined respectively to the four corners of panel 20 and extend laterally out from it. Each mounting strap has an upper piece and a lower piece which are connected end-to-end by a buckle of known design positioned between them and enabling the overall length of the strap to be slidably adjusted in a known manner.

As shown in FIGS. 2 and 3, the mounting strap 21 comprises an upper strap piece 21*a* joined to the corresponding corner of panel 20 and extending out from it across the top of mattress M and part-way down that side of the mattress to a buckle B, and a lower strap piece 21*b* extending down from buckle B to a mounting fastener in the form of a swivel snap hook 25 which is attachable, as shown, to a metal rail 26 of L-shaped cross-section which is part of the bed frame. Buckle B is of known design, with a male half engaging a female half with a snap fit. One example of such a buckle is the "Duraflex Stealth" buckle sold by National Molding Corporation, 5 Dubon Court, Farmingdale, N.Y.

11735. The buckle has a manual release of known design which permits the male and female halves to be separated from one another. The male half of buckle B adjustably receives one of the strap pieces 21*a* or 21*b*, and the female half receives the other, both in a known manner permitting the length of the corresponding strap piece 21*a* or 21*b* to be slidably lengthened or shortened, thereby adjusting the overall length of the strap 21 from panel 20 down to the snap hook 25. This snap hook may be one of the types sold by Velcro USA Inc., 406 Brown Avenue, Manchester, N.H. 03103.

The snap hook 25 of the mounting sub-assembly has a hook-shaped body 27 with a swivel joint 27*a* connected to the lower end of the lower strap piece 21*b*. The hook-shaped body 27 extends laterally inward from its swivel joint 27*a* beneath the bottom leg 26*a* of bed rail 26 and curves up and laterally outward in a return lip 27*b*, which is in overlying engagement with the top surface of the bottom leg 26*a* of bed rail 26 adjacent the latter's inboard edge. The snap hook also has a leaf spring 28 which extends laterally inward from its swivel joint 27*a* to a free end which normally is spring-biased against the inside of the return lip 27*b* of the main body of snap hook 27. Spring 28 is stressed further when the snap hook is applied to the bed rail 26 and the bed rail's bottom leg 26*a* is received between the hook body's return lip 27*b* and the free end of the spring, so that it holds the snap hook tightly in place on the bed rail 26.

Each of the other mounting straps 22, 23 and 24 has the same two-piece construction and is associated with a buckle identical to the buckle B for strap 21, and there is an identical snap hook on the lower end of each of the other two-piece straps 22, 23 and 24 for releasably fastening it to the frame of the bed as described and shown for the snap hook 25.

In accordance with the present invention, a short strap-and-fastener sub-assembly 30 for holding the baby is affixed to the top panel 20. This sub-assembly includes a short, fabric, baby holding strap 31 of suitable tensile strength whose left end 32 in FIGS. 1 and 2 is sewed or otherwise permanently affixed to panel 20. The opposite end of the baby holding strap 31 presents a loop 33 (FIG. 4) which holds the retainer 34 of a swivel-rotate snap hook 35 of known design (also sold by Velcro USA Inc.). Retainer 34 has a generally channel-shaped or U-shaped cross-section. Snap hook 35 has a hook-shaped body 37 and a leaf spring 38 like the corresponding elements of snap hook 25, already described in detail. Snap hook 35 holds a a baby holding fastener in the form of a safety pin 39 of known design which an adult may readily attach to the baby's diaper or another article of clothing on the baby to hold the baby in place on the mattress, with a limited range of movement permitted by the short strap 31. As is well known, the safety pin is a self-contained, complete fastener for attachment to a fabric article without requiring a complementary or cooperative fastener element on the fabric article itself.

Figure 12:
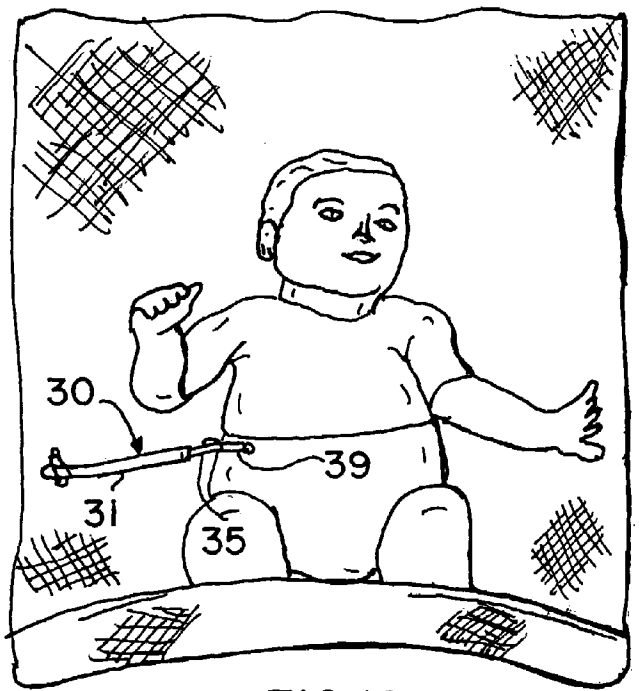
FIG. 12 is a top plan view showing a baby held on a mattress by the protector of FIGS. 10 and 11.

With this arrangement, an adult may readily position the top panel 20 of the baby protector on top of the mattress and adjust the lengths of the two-piece mounting straps 21, 22, 23 and 24 to fit the mattress, and then attach the snap hooks (e.g., 25) on the lower ends of these mounting straps to the bed rail, as described, to hold the top panel 20 snugly in place on the mattress. Then the adult places the baby on top of panel 20 and attaches the safety pin 39 to the baby's diaper or other article clothing, leaving the baby safely positioned as shown in FIG. 12. In most case, the baby will be lying on his or her back, as shown, but, if desired, the baby may be positioned face-down or on its side.

Figure 5:
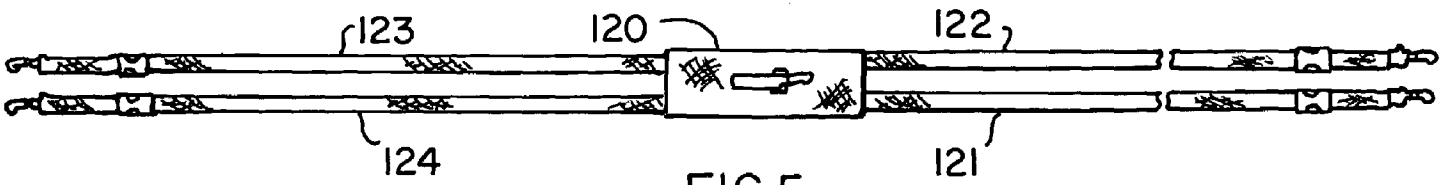
FIG. 5 is a top plan view of a second embodiment of the present baby protector.
Figure 6:
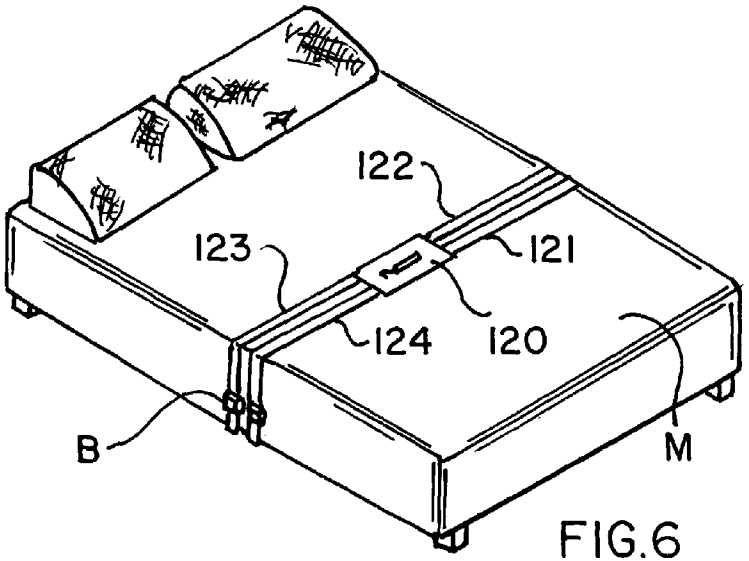
FIG. 6 is a perspective view of the FIG. 5 baby protector in place on a mattress.

FIGS. 5 and 6 show a second embodiment of the invention which differs from the embodiment of FIGS. 1–4 only in that the central top panel 120 of its mounting sub-assembly is much smaller than the central panel 20 in FIGS. 1–4, so the two-piece mounting straps 121–122 and 123–124 on either side of it are much closer together than those in the first embodiment of the invention. In all other particulars the embodiment of FIGS. 5 and 6 is identical to FIGS. 1–4, and therefore the detailed description of its elements need not be repeated.

Figure 7:
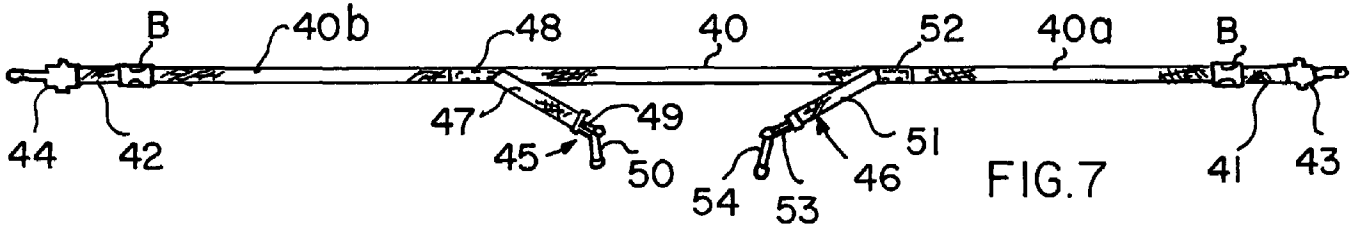
FIG. 7 is a top plan view of a third embodiment of the present baby protector.
Figure 8:
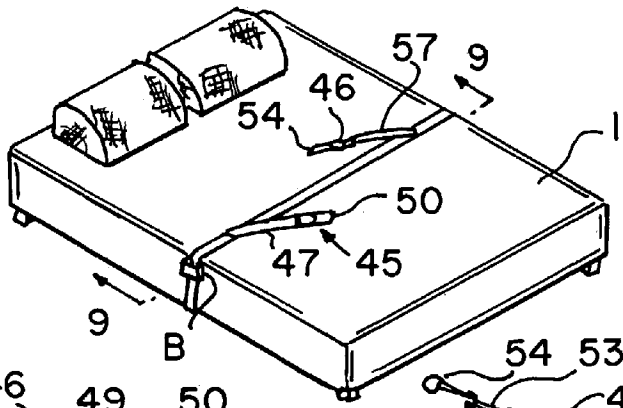
FIG. 8 is a perspective view of the FIG. 7 baby protector in place on a mattress.
Figure 9:
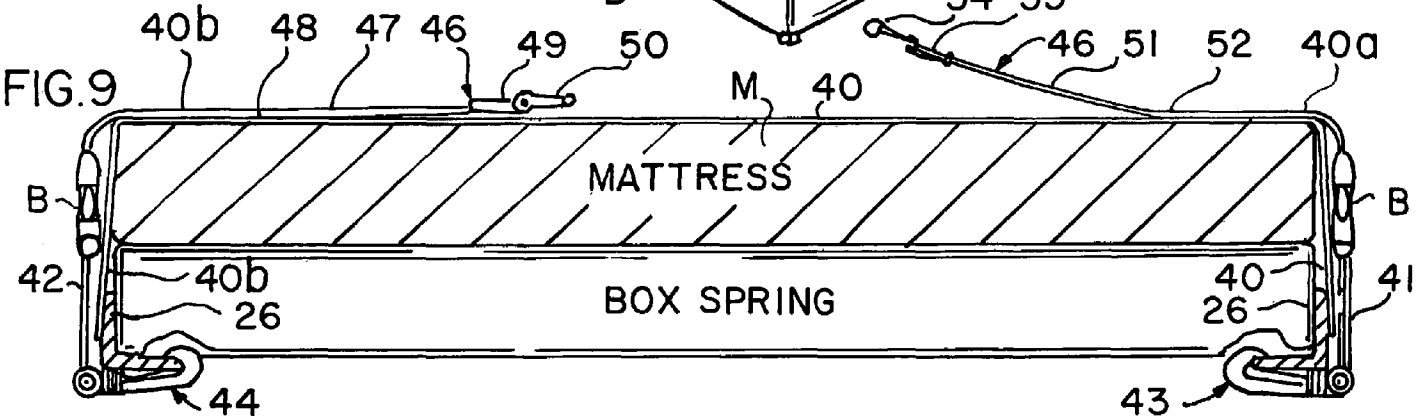
FIG. 9 is a cross-section taken along the line 9—9 in FIG. 8 next to the baby protector and showing its snap hook attachments to the bed frame.

FIGS. 7–9 show a third embodiment of the invention which has a mounting sub-assembly in which the central portion is a strap segment 40 between opposite upper side strap pieces 40*a* and 40*b* which extend laterally out from opposite ends of strap segment 40 down across the respective top side corners of the mattress. A buckle B on the lower end of each upper side strap piece 40*a* or 40*b* is located next to the corresponding side rail of the bed. A pair of lower side strap pieces 41 and 42 extend down from respective buckles B, and respective swivel snap hooks 43 and 44 are on the lower ends of these side strap pieces for attachment to the bed frame in the manner already described with reference to FIGS. 1–4.

Two baby holding strap sub-assemblies 45 and 46 are affixed to the central mounting strap segment 40 on opposite sides of where the baby will be positioned. The first baby holding strap sub-assembly 45 on one side has a relatively short strap 47 of suitable fabric that is stitched or otherwise permanently affixed at its laterally outboard end 48 to the top of the central mounting strap segment 40. Strap 47 on its laterally inboard free end carries a swivel-rotate snap hook 49 and a safety pin 50. Likewise, the second baby holding strap sub-assembly 46 on the opposite side has a short strap 51 with its outboard end permanently affixed at 52 to the top of the central mounting strap segment 40 and its inboard free end carrying a swivel-rotate snap hook 53 and a safety pin 54.

With this arrangement, the safety pins 50 and 54 are attached to the diaper or other article of clothing on opposite sides of the baby to hold the baby safely in place on the mattress.

Figure 10:
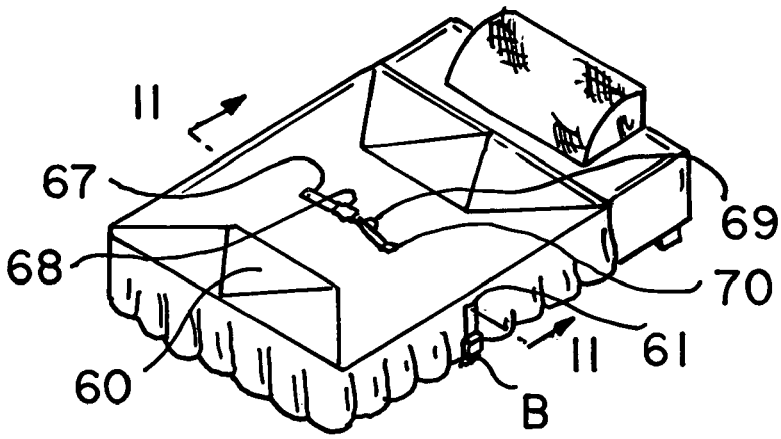
FIG. 10 is a perspective view of a fourth embodiment of the present baby protector in place on a bed.
Figure 11:
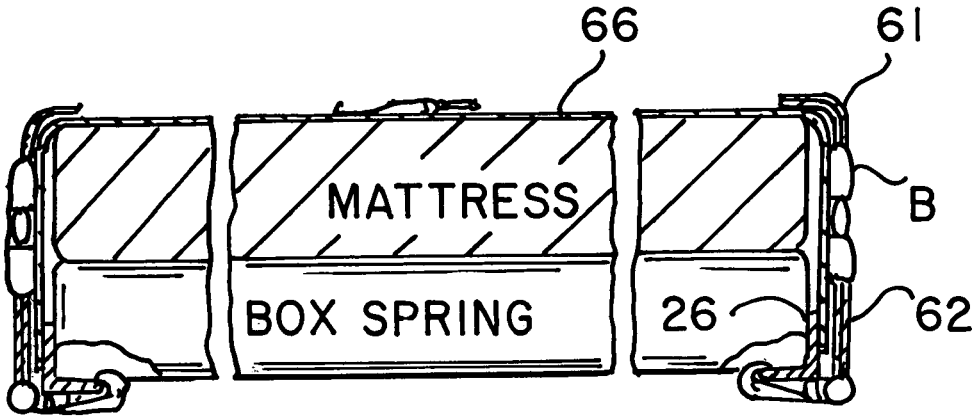
FIG. 11 is a cross-section taken along the line 11—11 in FIG. 10.

FIGS. 10 and 11 show a fourth embodiment of the invention in which a bed cover 60, such as a bedspread or a blanket, is the central portion of the mounting sub-assembly in the baby protector. Near the right side in FIG. 11 an upper side strap 61 is sewed or otherwise affixed to the top of the bedspread and extends down that side of the bed to a buckle B which also receives a lower side strap 62. A swivel snap hook 63 is connected to the lower end of strap 62 and is attached to the bed rail 26 in the manner already described with reference to FIGS. 1–4. One or both side straps 61 and 62 can be adjusted in the buckle to properly position the snap hook 63 on the bed frame so that it will not come loose accidentally.

An identical arrangement is provided on the left side in FIG. 11, consisting of an upper side strap 64 sewed to the bedspread, a buckle B, a lower side strap 65 extending down from the buckle, and a swivel snap hook 66 on the lower end of strap 65.

In this embodiment of the invention, a relatively short, baby holding strap 67 of suitable fabric is sewed or otherwise affixed to the top of the bedspread about midway from side-to-side and from top-to-bottom. At its laterally inboard end the baby holding strap 67 is formed with a loop 68 which holds a swivel-rotate snap hook 69 to which a safety pin 70 is connected in the manner already described. This safety pin will be attached to the baby's diaper or other clothing article to hold the baby safely on top of the bedspread.

From the foregoing description it will be apparent that each of the illustrated embodiments of the present baby protector achieves the objective of providing a safe, easily installed arrangement for holding the baby securely on a bed mattress of any size.

I claim:

1. A baby protector for holding a baby on a mattress on a bed having a frame, comprising:

a self-contained baby holding fastener for manually attachable and releasable connection to the baby's diaper;

a mounting sub-assembly comprising a central portion adapted to overlie the mattress, elongated flexible mounting straps connected to said central portion and extending laterally outward therefrom on opposite sides, and mounting fasteners on the ends of said straps away from said central portion for manually attachable and releasable connection to the bed frame at opposite sides of the bed;

and a short flexible baby holding strap attached at one end to said central portion of said mounting sub-assembly and having an opposite free end coupled to said baby holding fastener.

2. A baby protector according to claim 1, wherein said baby holding fastener is a safety pin.

3. A baby protector according to claim 2, wherein said mounting fasteners are snap hooks.

4. A baby protector according to claim 1, wherein said mounting fasteners are snap hooks.

5. A baby protector according to claim 1, and further comprising means for selectively adjusting individually the length of said mounting straps to fit the mattress.

6. A baby protector according to claim 5, wherein said mounting fasteners are snap hooks.

7. A baby protector according to claim 5, wherein each of said mounting straps has two strap pieces joined end-to-end by a buckle enabling said length adjustment.

8. A baby protector according to claim 7, wherein said mounting fasteners are snap hooks.

9. A baby protector according to claim 1, and further comprising a snap hook coupling said baby holding strap to said baby holding fastener.

10. A baby protector according to claim 9, wherein said baby holding fastener is a safety pin.

11. A baby protector according to claim 10, wherein said mounting fasteners are snap hooks.

12. A baby protector according to claim 11, wherein each of said mounting straps has two strap pieces joined end-to-end by a buckle enabling length adjustment of said mounting strap.

13. A baby protector according to claim 12, wherein said central portion of the mounting sub-assembly is a rectangular fabric panel, and said mounting straps are joined to respective corners of said panel.

14. A baby protector according to claim 12, wherein said central portion of the mounting sub-assembly is a strap segment between said mounting straps, and further comprising: an additional short flexible baby holding strap attached at one end to said strap segment and extending laterally therefrom toward said first-mentioned baby holding strap and terminating in a free end; an additional snap hook on said free end of said additional baby holding strap; and an additional safety pin on said additional snap hook.

15. A baby protector according to claim 12, wherein said central portion of the mounting sub-assembly is a bed cover dimensioned to substantially cover the top of said mattress.

16. A baby protector according to claim 10, wherein each of said mounting straps has two strap pieces joined end-to-end by a buckle enabling length adjustment of said mounting strap.

17. A baby protector according to claim 1, wherein said central portion of the mounting sub-assembly is a fabric panel, and said mounting straps are joined to said panel at respective edges thereof.

18. A baby protector according to claim 1, wherein said central portion of the mounting sub-assembly is a strap segment between said mounting straps, and further comprising: an additional short flexible baby holding strap attached at one end to said strap segment and extending laterally therefrom toward said first-mentioned baby holding strap and terminating in a free end; and an additional baby holding fastener on said free end of said additional baby holding strap.

19. A baby protector according to claim 1, wherein said central portion of the mounting sub-assembly is a bed cover dimensioned to substantially cover the top of said mattress.

* * * * *